US007911153B2

(12) United States Patent
Srimuang

(10) Patent No.: US 7,911,153 B2
(45) Date of Patent: Mar. 22, 2011

(54) ELECTRONIC BALLASTS FOR LIGHTING SYSTEMS

(75) Inventor: Paul Srimuang, San Diego, CA (US)

(73) Assignee: Empower Electronics, Inc., San Diego, CA (US)

( * ) Notice: Subject to any disclaimer, the term of this patent is extended or adjusted under 35 U.S.C. 154(b) by 687 days.

(21) Appl. No.: 11/847,227

(22) Filed: Aug. 29, 2007

(65) Prior Publication Data

US 2008/0180037 A1 Jul. 31, 2008

Related U.S. Application Data

(60) Provisional application No. 60/947,624, filed on Jul. 2, 2007.

(51) Int. Cl.
*H05B 37/02* (2006.01)

(52) U.S. Cl. .... 315/291; 315/224; 315/307; 315/DIG. 5

(58) Field of Classification Search ..... 315/291, 315/307, 224, DIG. 5, DIG. 7
See application file for complete search history.

(56) References Cited

U.S. PATENT DOCUMENTS

| | | | |
|---|---|---|---|
| 4,127,798 | A | 11/1978 | Anderson |
| 4,170,747 | A | 10/1979 | Holmes |
| 4,277,728 | A | 7/1981 | Stevens |
| 4,373,146 | A | 2/1983 | Bonazoli et al. |
| 4,415,839 | A | 11/1983 | Lesea |
| 5,041,767 | A | 8/1991 | Doroftei et al. |
| 5,192,897 | A | 3/1993 | Vossough et al. |
| 5,204,587 | A | 4/1993 | Mortimer et al. |
| 5,471,119 | A | 11/1995 | Ranganath et al. |
| 5,493,182 | A | 2/1996 | Sowa et al. |
| 5,612,597 | A | 3/1997 | Wood |
| 5,680,015 | A | 10/1997 | Bernitz et al. |
| 5,691,605 | A | 11/1997 | Xia et al. |
| 5,757,630 | A | 5/1998 | Lesea |
| 6,002,214 | A | 12/1999 | Ribarich |
| 6,020,689 | A | 2/2000 | Gradzki et al. |
| 6,040,661 | A | 3/2000 | Bogdan |
| 6,072,283 | A | 6/2000 | Hedrei et al. |
| 6,259,215 | B1 | 7/2001 | Roman |
| 6,639,369 | B2 | 10/2003 | Ribarich |
| 6,759,813 | B2 | 7/2004 | Busse et al. |
| 2002/0158591 | A1 * | 10/2002 | Ribarich et al. ..... 315/291 |
| 2004/0066153 | A1 | 4/2004 | Nemirow et al. |
| 2004/0257004 | A1 | 12/2004 | Deurloo et al. |

(Continued)

FOREIGN PATENT DOCUMENTS

WO WO 2007007254 A1 1/2007

OTHER PUBLICATIONS

PCT International Search Report; PCT/US2007/085186 filed Nov. 20, 2007.

(Continued)

*Primary Examiner* — David Hung Vu
(74) *Attorney, Agent, or Firm* — Roeder & Broder LLP; James P. Broder

(57) ABSTRACT

A microprocessor controlled electronic ballast for lighting equipment is described wherein light level control is performed by varying the power provided to the light. Lighting power is adjusted by driving the lamp through a resonant circuit with a variable frequency power signal. The programmable microprocessor controls overall operation including preheating, ignition, and shutdown.

28 Claims, 10 Drawing Sheets

U.S. PATENT DOCUMENTS

2005/0093479 A1 5/2005 Deurloo et al.

OTHER PUBLICATIONS

GE Consumer and Industrial Lighting see HID in a whole new light, UltraMax HID Superior Lumen Maintenance, A quantum Leap in HID system performance for 250/300/320/350/400-watt pulse-start and CMH lamps, 2004 General Electric Company.

Electric HID Ballasts, DynaVision for 320/350/400 Watt Pulse Start Metal Halide Lamps, Introducing breakthrough electronic HID performance DynaVision, 2004 Advance Transformer Co.

* cited by examiner

ELECTRONIC BALLASTS FOR LIGHTING SYSTEMS

CROSS-REFERENCE TO RELATED APPLICATIONS

This application claims priority under 35 U.S.C. §119(e) to U.S. Provisional Patent Application Ser. No. 60/947,624 entitled ELECTRONIC BALLASTS FOR LIGHTING SYSTEMS, filed Jul. 2, 2007, the content of which is incorporated by reference herein in its entirety for all purposes. This application also claims priority under 35 U.S.C. §119(a) to Thailand Patent Application Serial No. 0703000099, filed on Jan. 29, 2007, the content of which is incorporated herein by reference in its entirety for all purposes.

BRIEF DESCRIPTION OF THE INVENTION

This invention relates generally to lighting systems using ballasts. More particularly but not exclusively, this invention relates to HID lighting systems employing electronic ballasts to drive lighting elements.

BACKGROUND OF THE INVENTION

Ballasts are an integral part of many gas discharge systems such as fluorescent or high intensity density discharge (HID) lighting. Ballasts are used to regulate the flow of electrical current to an illuminating element (also denoted herein as lighting element or lamp) to generate and maintain electromagnetic illumination (also denoted herein as illumination or light).

Fluorescent ballasts are commonly used in office lighting, and compact fluorescent lamps with integrated ballasts are widely used for domestic lighting. HID lighting systems, on the other hand, are typically used for lighting in larger facilities such as large retail stores, industrial buildings, and studios. HID lighting is also commonly used in parking lots and for street lighting. HID systems can consist of metal halide (MH) lighting systems as well as high pressure sodium (HPS) lighting systems.

Traditional fluorescent lighting incorporates electromagnetic adaptors or ballasts to power the lamp. Standard electromagnetic HID ballasts utilize a basic low frequency iron core transformer, a capacitor, and in the case of high pressure sodium lighting systems an additional igniter. These components ignite and maintain the lamp in a desired operating state, supplying the required power in an appropriate form.

However, electromagnetic ballasts exhibit a number of disadvantages including: poor energy efficiency; susceptibility to incoming voltage fluctuations; hard initial start up which degrades the life expectancy of the lamp; general inability to be dimmed; large weight making them difficult to install in above ground locations; many wires to interconnect which complicates installation; audible noise production as the device ages; relatively high operating temperatures; potential for damage by power surges; as well as other disadvantages.

SUMMARY OF THE INVENTION

In one aspect the present invention relates to a ballast including a lamp control subsystem disposed to provide a lamp control signal, a lamp drive subsystem disposed to receive the lamp control signal and provide a lamp drive signal, and an output network disposed to receive the lamp drive signal and provide a lamp drive output signal.

In another aspect the present invention relates to a lamp control subsystem including a ballast control circuit for providing a lamp control signal, a processor operatively coupled to the ballast control circuit, and a memory, operatively coupled to the processor, the memory configured to store processor readable logical instructions wherein execution of the logical instructions by the processor results in the performing at least the operations of controlling a predefined lamp ignition sequence, determining whether a lamp operatively connected to the ballast has ignited, and based on the determining, controlling, in part, operation of the lamp.

In another aspect the present invention relates to a ballast including a lamp control subsystem disposed to provide a lamp control signal, a lamp drive subsystem disposed to receive the lamp control signal and provide a lamp drive signal, and an output network disposed to receive the lamp drive signal and provide a lamp drive output signal. The lamp control subsystem further including a phase control circuit disposed to maintain the lamp drive output signal at a user-selectable output power level by measuring the phase between the voltage and current of the lamp drive output signal and adjusting the frequency of the lamp drive output signal to maintain the user-selectable output power level, wherein the user selectable output power level is related to the phase between the voltage and current.

In another aspect the present invention relates to a ballast including a lamp control subsystem disposed to provide a lamp control signal, a lamp drive subsystem disposed to receive the lamp control signal and provide a lamp drive signal, an output network disposed to receive the lamp drive signal and provide a lamp drive output signal, and an isolation circuit disposed to receive a lamp power level input signal and provide the lamp power level signal, the isolation circuit disposed to electrically isolate the lamp power level signal and the lamp power level input.

In another aspect the present invention relates to a ballast including a lamp control subsystem disposed to provide a lamp control signal, a lamp drive subsystem disposed to receive the lamp control signal and provide a lamp drive signal, an output network disposed to receive the lamp drive signal and provide a lamp drive output signal, a power supply circuit disposed to receive power from an external power source and provide one or more voltage regulated power sources to the lamp control subsystem and lamp drive subsystem, and a power factor correction module disposed to provide a substantially constant input power factor to the external power source.

In another aspect the present invention relates to a ballast including a lamp control subsystem disposed to provide a lamp control signal, a lamp drive subsystem disposed to receive the lamp control signal and provide a lamp drive signal, and an output network disposed to receive the lamp drive signal and provide a lamp drive output signal, the output network including a resonant tuned circuit.

In another aspect the present invention relates to a method of providing electrical power to a lamp including receiving an adjustable power level signal, providing an AC lamp drive signal to a reactive output network, measuring the phase difference between a voltage and current of the AC lamp drive signal at the reactive output network, and adjusting a frequency of the AC lamp drive signal to maintain an adjustable phase difference between the voltage and current, the adjustable phase difference being based on the adjustable power level signal.

In another aspect the present invention relates to a method of starting a lamp using a ballast, including performing a predefined ignition cycle, determining if said lamp has ignited, performing again, after a predefined time period, the predefined ignition cycle if said lamp has not ignited, repeating to the extent said lamp has not ignited, said predetermined ignition cycle up to a predetermined number of times, and placing said ballast in a latched shutdown state if said lamp has not ignited.

In another aspect the present invention relates to a lighting system including a HID lamp and a ballast including a lamp control subsystem disposed to provide a lamp control signal, a lamp drive subsystem disposed to receive the lamp control signal and provide a lamp drive signal, and an output network disposed to receive the lamp drive signal and provide a lamp drive output signal.

Additional aspects of the present invention are further described and illustrated herein.

BRIEF DESCRIPTION OF THE FIGURES

The invention is more fully appreciated in connection with the following detailed description taken in conjunction with the accompanying drawings, wherein.

DETAILED DESCRIPTION OF THE INVENTION

The present invention is generally related to lighting systems employing ballasts. While embodiments of the present invention disclosed below are typically described in terms of electronic ballasts configured to drive high intensity discharge (HID) lighting elements, the systems and methods described herein are not so limited, and embodiments based on other configurations are possible and fully contemplated herein. Accordingly, the embodiments disclosed are merely provided for purposes of illustration, not limitation.

In one aspect, the present invention is directed towards systems and methods for providing an electronic high intensity discharge ballast capable of driving a variety of different types of metal halide and high pressure sodium lamps.

In another aspect the present invention is related to an electronic circuit for driving a gas discharge illumination device, the circuit combining a ballast control IC which incorporates a phase regulation scheme for lamp power regulation operating in conjunction with a microcontroller and half-bridge low and high side driver to operate MOSFET switches in a Half-bridge configuration to produce a square wave switching at high frequency between approximately 0 volts and a regulated high voltage. This high frequency switching voltage is then used to supply power to the output through a resonant output circuit consisting of a series inductor and parallel capacitor. The lamp power can be varied by adjusting the frequency of the switching voltage. This power can be externally adjusted by means of an isolated 0 to 10 VDC power control interface.

In another aspect the present invention relates to an electronic high intensity discharge ballast for an illumination device comprising a programmed start sequence within the microcontroller, which allows multiple attempts to be made to ignite the lamp which occur at regular intervals, until after a defined number of attempts have been made and it can be determined that the lamp is not capable of igniting, in which case the ballast will shut down safely until AC power to the ballast is recycled.

Additional aspects of the present invention are also contemplated as further described herein.

In the description which follows, like parts are marked throughout the specification and the drawings with the same respective reference designators.

Figure 1:
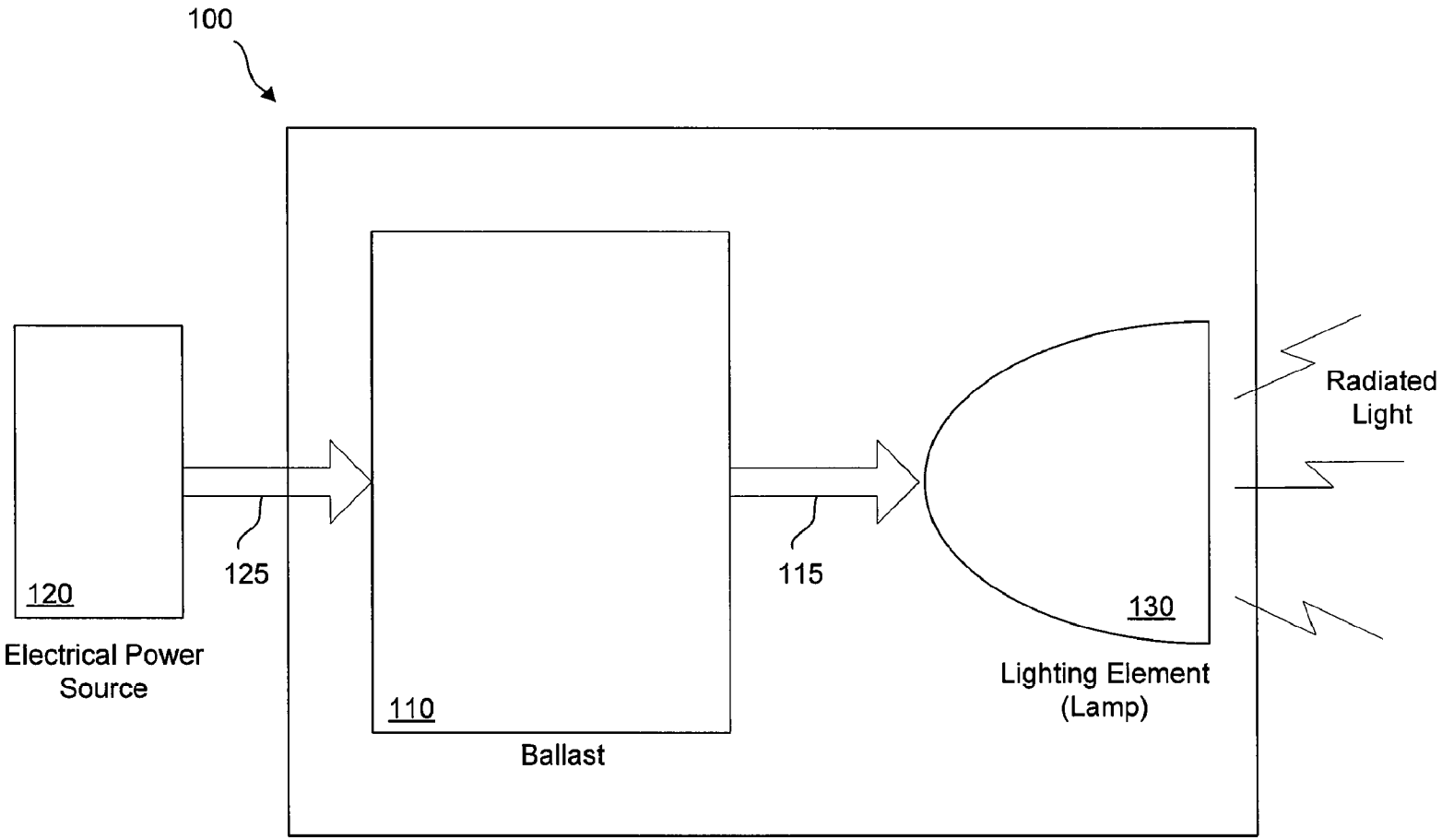
FIG. 1 illustrates a typical ballast driven lighting system.

Turning now to the drawings, FIG. 1 illustrates an embodiment of an electromagnetic illumination device 100 in accordance with aspects of the present invention. As shown in FIG. 1, an illumination device 100 configured to generate electromagnetic radiation may comprise a ballast 110 configured to provide electrical power through power transmission line 115, such as a pair of copper wires, to a lighting element (also denoted herein as a lamp) 130. The electrical power provided by power transmission line 115 provides energy to lamp 130 to generate electromagnetic radiation, typically in the visible light spectrum. It will be noted, however, that emissions from lamp 130 are not strictly limited to visible light and other emission wavelengths are possible.

Electrical power may be provided to illumination device 100 in the form of an alternating current with varying on/off cycles, frequencies, amplitudes, and other characteristics as further described herein to power lamp 130 in a controlled fashion. Illumination device 100 is typically driven by an electrical power source 120 providing input electrical power through input power transmission line 125. For example, input power may be in the form of an alternating current (AC) source providing electrical energy at a standard frequency such as 50 or 60 Hz and at standard power voltage such as 120 VAC, 220 VAC, 277 VAC or other standard or custom power supply frequencies and voltages. It will also be noted that in some embodiments ballast 110 may be driven by direct current (DC) power at a standard or custom voltage level.

Figure 2:
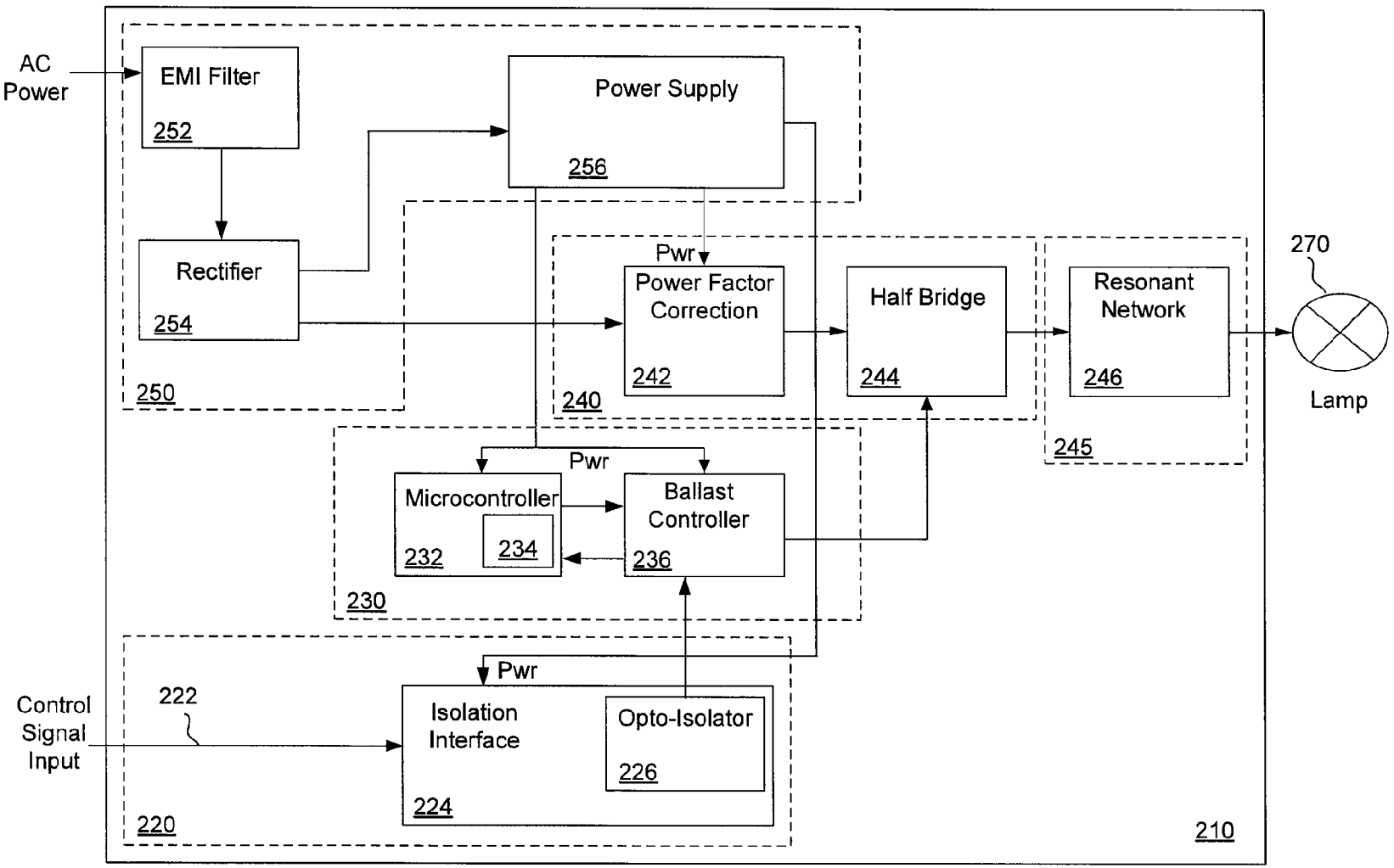
FIG. 2 is a block diagram of one embodiment of a high intensity discharge (HID) ballast in accordance with aspects of the present invention.

FIG. 2 identifies a set of functional blocks and interconnections comprising an embodiment of a HID ballast 210 in accordance with the present invention. Ballast 210 may be configured to provide the functionality of ballast element 110 as shown in FIG. 1. Ballast 210 may include one or more of the elements shown in FIG. 2 or their equivalents, and in a typical embodiment will include all elements or the equivalents of those shown in FIG. 2. In an exemplary embodiment ballast 210 includes a control signal isolation interface subsystem (also denoted herein for brevity as isolation subsystem) 220, a lamp control subsystem 230, a lamp driver subsystem 240, an output subsystem 245, and a power supply subsystem 250.

Isolation subsystem 220 may be configured to interface to an external control signal and provide an internal control signal to lamp control subsystem 230. Power supply subsystem 250 may be configured to provide rectified power to lamp driver subsystem 240 and regulated power to other subsystems as shown in FIG. 2. Lamp control subsystem 230 may be configured to provide control signals to lamp driver subsystem 240 to control initiation and termination of lamp 270 emission, as well as regulate lamp 270 emission during normal operation. Additional details of embodiments of these subsystems as shown in FIG. 2 are provided in subsequent sections.

Power supply subsystem 250 may be configured to accept power from AC or DC sources. In an exemplary embodiment, power may be supplied to ballast 210 in the form of AC electrical power to one or more power coupling elements such as electromagnetic interference (EMI) filter module 252. Filter module 252 may be connected to the AC power supply input to remove energy outside of the normal AC operating frequencies and amplitudes. Filter module 252 may be followed by a rectifier module 254 configured to rectify the AC input to provide rectified AC and/or DC power out. In an exemplary embodiment rectifier module 254 is configured as a full wave bridge rectifier. The output of rectifier module 254 may be provided to a power supply module 256 such as, in an exemplary embodiment, a flyback power supply module. Power supply module 256 may be configured to supply power at different voltages to other subsystems and modules of ballast 210, such as a microcontroller module 232, ballast controller module 236, isolated interface module 224, and other modules within ballast 210 requiring power at particular voltages and currents, typically as DC power at a regulated voltage.

Rectifier module 254 may also provide output power to a power factor correction (PFC) module 242 within lamp driver subsystem 240. Power factor correction module 242 may be configured to receive a rectified input voltage from bridge rectifier module 254 and provide a regulated DC bus current to a half-bridge inverter module 244. Half-bridge inverter module 244 may be configured to receive power from power correction factor module 242 and generate a square wave output at a variable frequency which may be provided to an output subsystem 245, such an output subsystem including a resonant output network 246. Half-bridge inverter module 244 may be configured to receive power from power factor correction module 242 and control signals from ballast control module 236 within control subsystem 230. Ballast control module 236 may be configured to generate control signals to maintain a constant phase in a resonant output network 246. The phase shift caused by resonant output network 246 may be set as a function of the output frequency of half-bridge inverter module 244 so that the output power to lamp 270 may be adjusted based on a control signal provided through isolation subsystem 220 and lamp control subsystem 230.

Ballast 210 may also include one or more control modules such as microcontroller module 232 and ballast controller module 236. Microcontroller module 232 may include one or more processors, such processors being single or multiple chip computer devices as are known in the art such as microprocessors, microcontrollers, or other programmable digital devices as are known in the art. Ballast controller module 236 may be provided to regulate the output power of lamp 130 by maintaining a constant phase shift in resonant output network 246. This may be done by modulating the output frequency of half-bridge inverter module 244, where the phase shift provided by resonant output network 246 is a function of the desired lamp power. Microcontroller module 232 may include one or more software modules 234 to provide functionality as further detailed in successive sections herein, including operating in conjunction with ballast control module 236 to produce a specified sequence of timed ignition attempts.

A control input signal 222 may be provided through a control input interface comprised of an isolation interface module 224. Isolation interface 224 may be configured to isolate control input signal 222 from internal signals within ballast 210 and provide a desired output signal based on control input signal 222. In an exemplary embodiment, isolation interface module 224 comprises an industry standard isolated 0 to 10V DC control interface. Interface module 224 may be powered by a power signal provided by power supply module 256, or in an exemplary embodiment may be powered by a galvanically isolated internal voltage supply derived from power supply module 256. Isolation interface 224 may further be configured to generate a square wave output at a constant frequency to be supplied to ballast controller module 236. The square wave output may be provided with a variable duty cycle wherein the duty cycle is varied proportionately as a function of the applied control signal input 222, and the square wave may further be converted back to a DC voltage in ballast controller module by converting the square wave duty cycle back to exactly or approximately the original DC voltage by, for example, a low pass filter. The DC voltage may then be used by ballast controller module 236 as a phase reference source. In some embodiments isolation interface module 224 may also include an optical isolation sub-module 226 to provide optically coupled isolation of interface module 224 from ballast controller 236.

Embodiments of EMI Filter and Rectifier Modules

Figure 4:
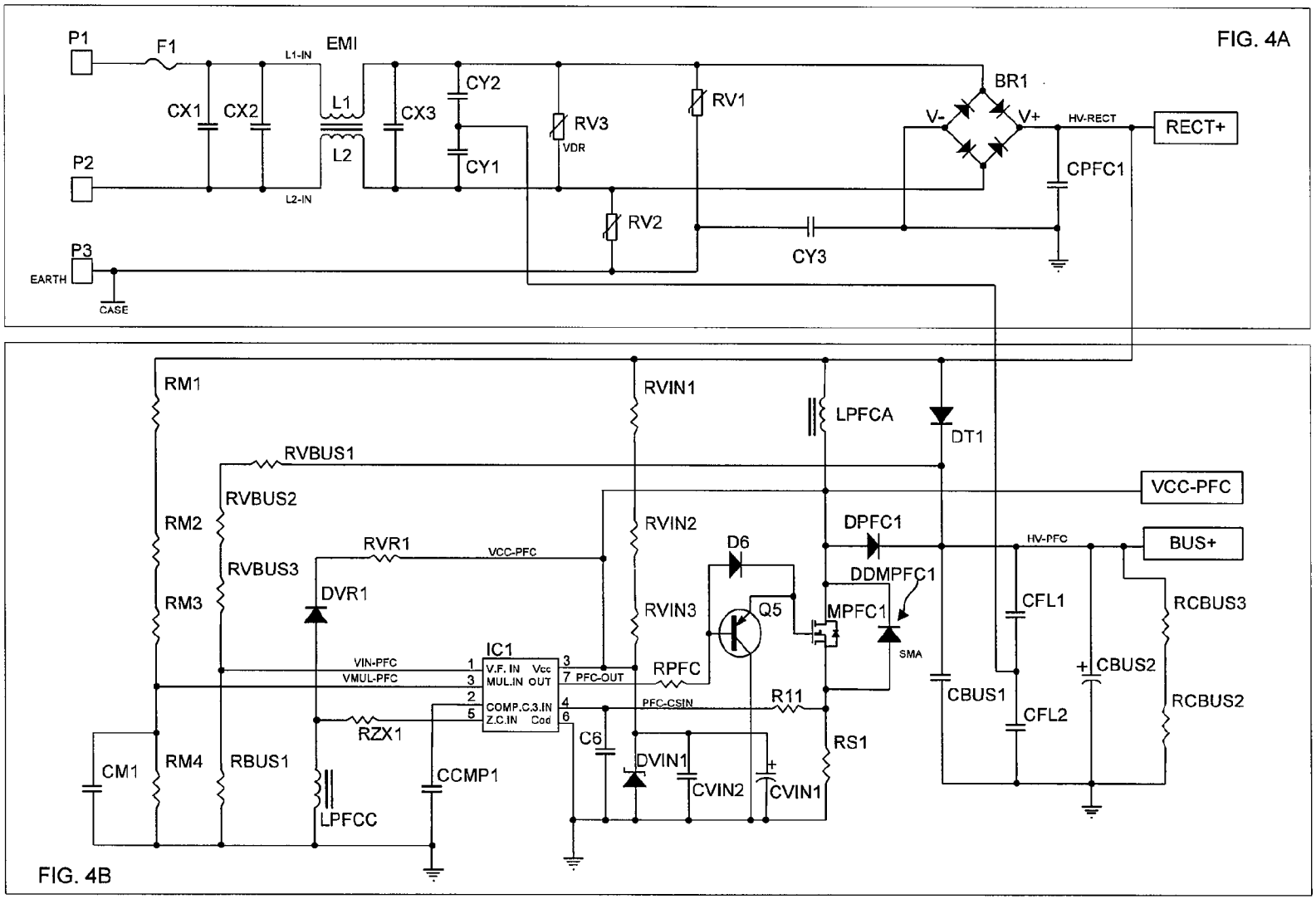
FIG. 4A is a circuit schematic of one embodiment of a EMI filter and rectifier module in accordance with aspects of the present invention.
FIG. 4B is a circuit schematic of one embodiment of a power factor correction module in accordance with aspects of the present invention.

Attention is now directed to FIG. 4 which illustrates embodiments of modules within subsystems 240 and 250. It will be noted that the circuits as shown include referenced circuit elements denoted by standard circuit element designators. The descriptions of circuit embodiments that follow are made with respect to the circuit designators as shown in the figures, however, it will also be noted that the function of some of the circuit elements as shown in the figures will be recognized by one of ordinary skill in the art and therefore description of their functionality will be omitted in the interests of brevity.

Subfigure FIG. 4A illustrates one embodiment of an EMI filter module 252 and rectifier module 254. The EMI filter module 252 is configured to reduce noise and spikes and filter out harmonics of an incoming alternating current supply, typically at 50 to 60 Hertz, as well as block conducted emissions from the ballast to the power line. As shown in FIG. 4A, an AC input voltage is fed through a fuse F1 to an EMI filter circuit consisting of elements EMI filter (L1 & L2), CX1, CX2, CX3, CY1, CY2, and CY3 which are configured to reduce conducted emissions produced by high frequency power switching within the ballast to acceptable levels as specified in relevant FCC standards. A varistor RV3 or similar device may also be included to absorb high voltage transients or surges that may occur on the AC line and which could damage components within the ballast.

The input voltage is then rectified by full wave bridge rectifier BR1 to produce a DC voltage at capacitor CPFC1, which provides a rectified and filtered voltage source to the power factor correction module 242 as well as, in some embodiments, to other circuit stages or modules. While the circuit shown in FIG. 4 illustrates one embodiment of an EMI filter and rectifier circuit, it will be apparent to one of skill in the art that other EMI filter and rectifier configurations may be also be employed while keeping within the spirit and scope of the invention.

Embodiments of Power Factor Correction (PFC) Modules

FIG. 4B illustrates an embodiment of a multi-stage power factor correction circuit (PFC) such as might be employed in power factor correction module 242 as shown in FIG. 2. As shown in FIG. 4B, a front end power factor correction stage comprises a Boost regulator consisting of inductor LPFCA, MOSFET switch MPFC1, and Boost diode DPFC1. A pulse width modulated gate signal for driving MPFC1 is provided by means of a dedicated industry standard critical conduction mode power factor controller integrated circuit, IC1. The circuit configuration of the power factor correction stage provides a substantially constant DC bus voltage, BUS+, of approximately 450V from which ballast half-bridge module 244 will be supplied, and in addition provides a high power factor at the ballast input to minimize reactive loading to the input power supply. The power factor correction stage as shown in FIG. 4B is designed to maintain these operational characteristics over a wide range of input supply voltages, for example in a typical embodiment from 120 VAC to 277 VAC, thus allowing a common ballast design to be used in many different parts of the world where available power supply line voltages vary.

In an exemplary embodiment, IC1 is an MC34262 Power Factor Controller, available from ON Semiconductor (www.onsemi.com). The circuit shown in FIG. 4B uses an error amplifier within this IC to sense the DC bus voltage and compare it with a reference voltage to produce an error voltage that determines the on time of a pulse width modulated (PWM) signal controlling MOSFET switch MPFC1. The error amplifier in IC1 also includes the necessary compensation for the voltage control loop.

A single quadrant, two input multiplier in IC1 enables this device to control power factor. The AC full wave rectified haversines are monitored at pin 3 of IC1 with respect to ground, while the error amplifier output at pin 2 is monitored with respect to the voltage feedback input threshold. The multiplier output controls the current sense comparator threshold as the AC voltage traverses sinusoidally from zero to peak line. This forces the MOSFET on time to track the input line voltage, resulting in a fixed PWM drive on time, thus making the PFC preconverter load appear to be resistive to the AC line. In addition, the current in the switch is sensed through shunt resistor RS1, which feeds the input of the current sense comparator.

The power factor correction circuitry operates as a critical conduction mode controller, whereby output switch conduction is initiated by the zero current detector and terminated when the peak inductor current reaches the threshold level established by the multiplier output. The zero current detector initiates the next on time at the instant when the inductor current, which is detected by means of an auxiliary winding of PFC inductor LPFCA, reaches zero. This mode of operation may provide at least two potentially significant benefits.

First, since the MPFC1 cannot turn on until the inductor current reaches zero, the reverse recovery time of the output rectifier DPFC1 becomes less critical, allowing the use of a less expensive rectifier in exemplary embodiments. Second, since there are no dead time gaps between cycles, the AC line current is continuous, thus limiting the peak current in switch MPFC1 to twice the average input current.

Consequently, in exemplary embodiments this system is capable of producing power factor in the vicinity of 0.99 low THD (total harmonic distortion). Moreover, an over voltage comparator, such as the internal voltage comparator of IC1, may be used to inhibit the PFC section in the event of a lamp out or lamp failure condition, preventing the DC bus voltage from rising to a high enough level to damage the components. This comparator is typically set to limit voltage to approximately 1.1 times the nominal bus voltage.

Embodiments of a Ballast Circuitry VCC Power Supply

Figure 5:
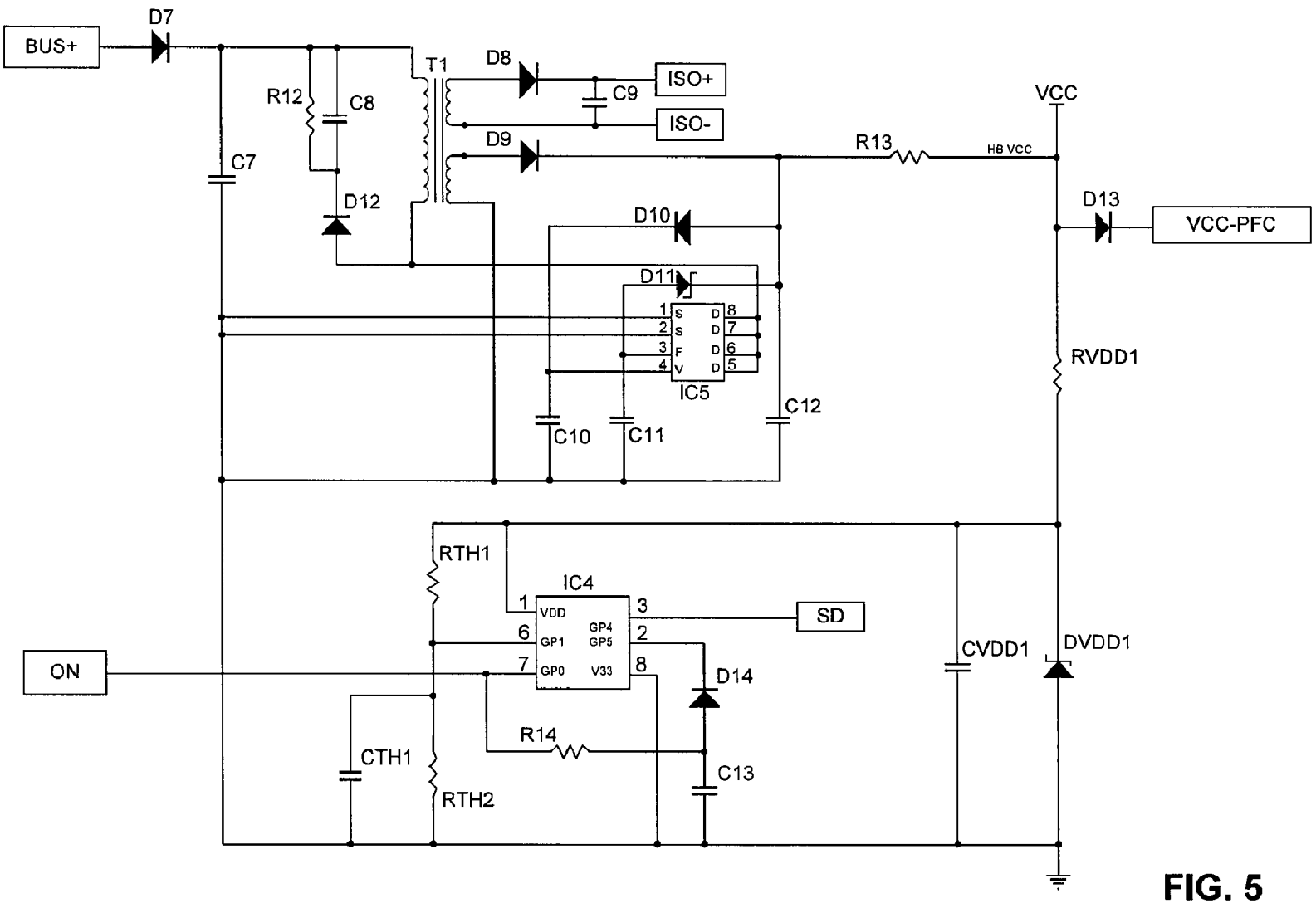
FIG. 5 is a circuit schematic of one embodiment of an internal supply circuitry and microcontroller in accordance with aspects of the present invention.

As shown in FIG. 2, in typical embodiments ballast 210 includes an onboard power supply 256 to generate the necessary low voltage power supplies required by the control circuitry. An embodiment of power supply 256 is shown in FIG. 5. As shown in FIG. 5, in an exemplary embodiment, a power supply circuit may be based on a VIPer12 integrated Flyback regulator and switch (IC5), available from ST Microelectronics, which provides a low voltage supply for VCC (14V) of ballast control module 236, along with half-bridge level shift and gate drive circuitry. IC5 contains a PWM circuit and a vertical power MOSFET, which is avalanche rugged, on the same silicon chip. This device is suitable for off line wide range input voltage power supplies up to 6 W, which is sufficient for typical applications as described herein. This implementation has the advantage of using fewer external components compared to a discrete implementation, a fixed frequency of operation at 50 kHz with current mode control, built in current limiting, and thermal protection. The VIPer12 also incorporates a burst mode of operation, which prevents the possibility of the voltage rails going too high in a fault condition.

In a typical embodiment as shown in FIG. 5, the internal power supply is designed as a discontinuous flyback regulator where the energy is stored in a coupled inductor (T1) and delivered to the output winding, which supplies ballast control module 236, and also the isolated auxiliary winding, which supplies the isolation interface 224. IC5 operates by monitoring the current into feedback pin 3. When the current is zero, IC5 is operating at its full power level. When a feedback current of close to 1 mA is reached, IC5 shuts down. Regulation is achieved by controlling the current into the feedback pin.

Figure 6:
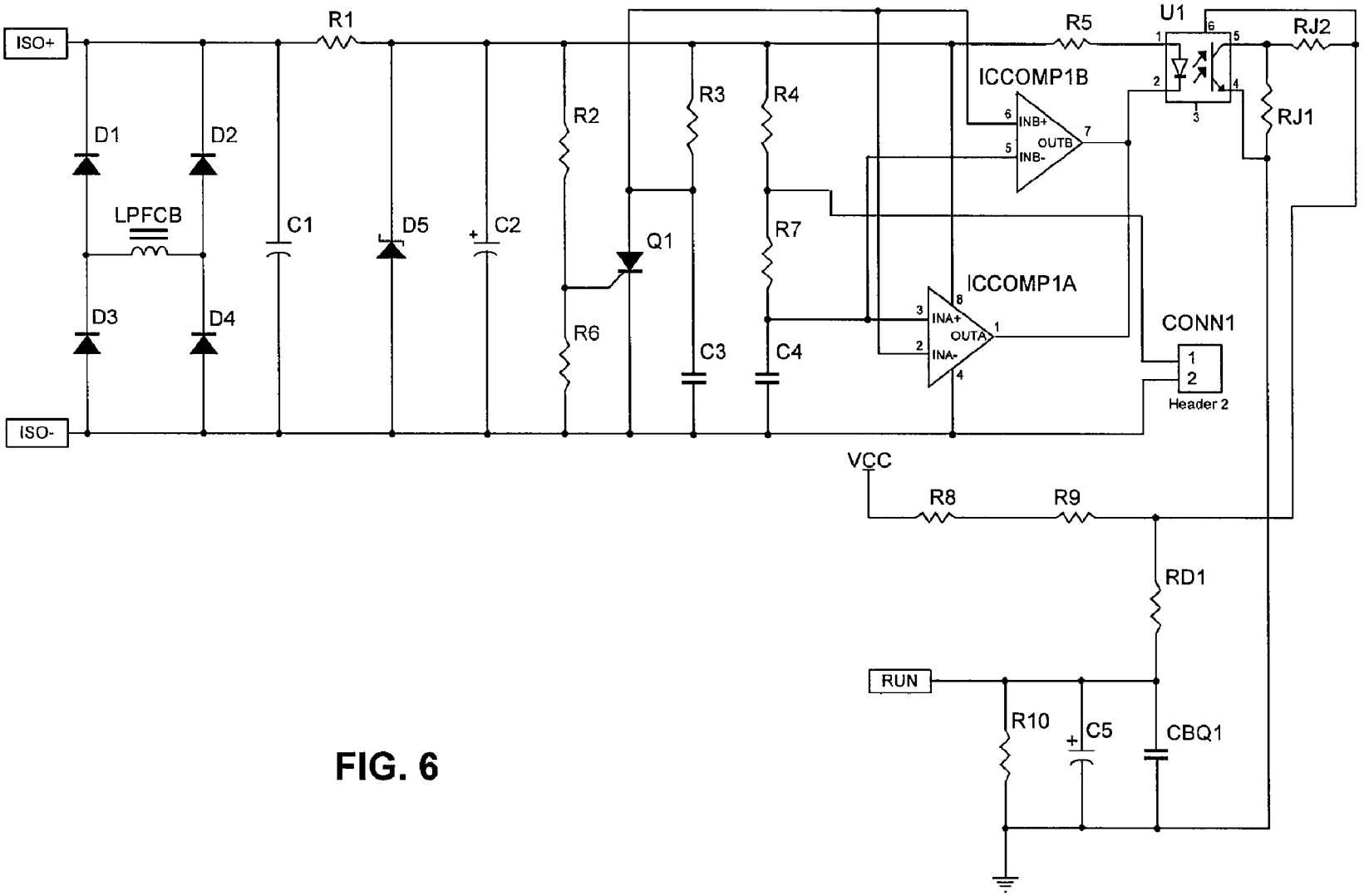
FIG. 6 is a circuit schematic of one embodiment of an isolated power control interface in accordance with aspects of the present invention.
Figure 7:
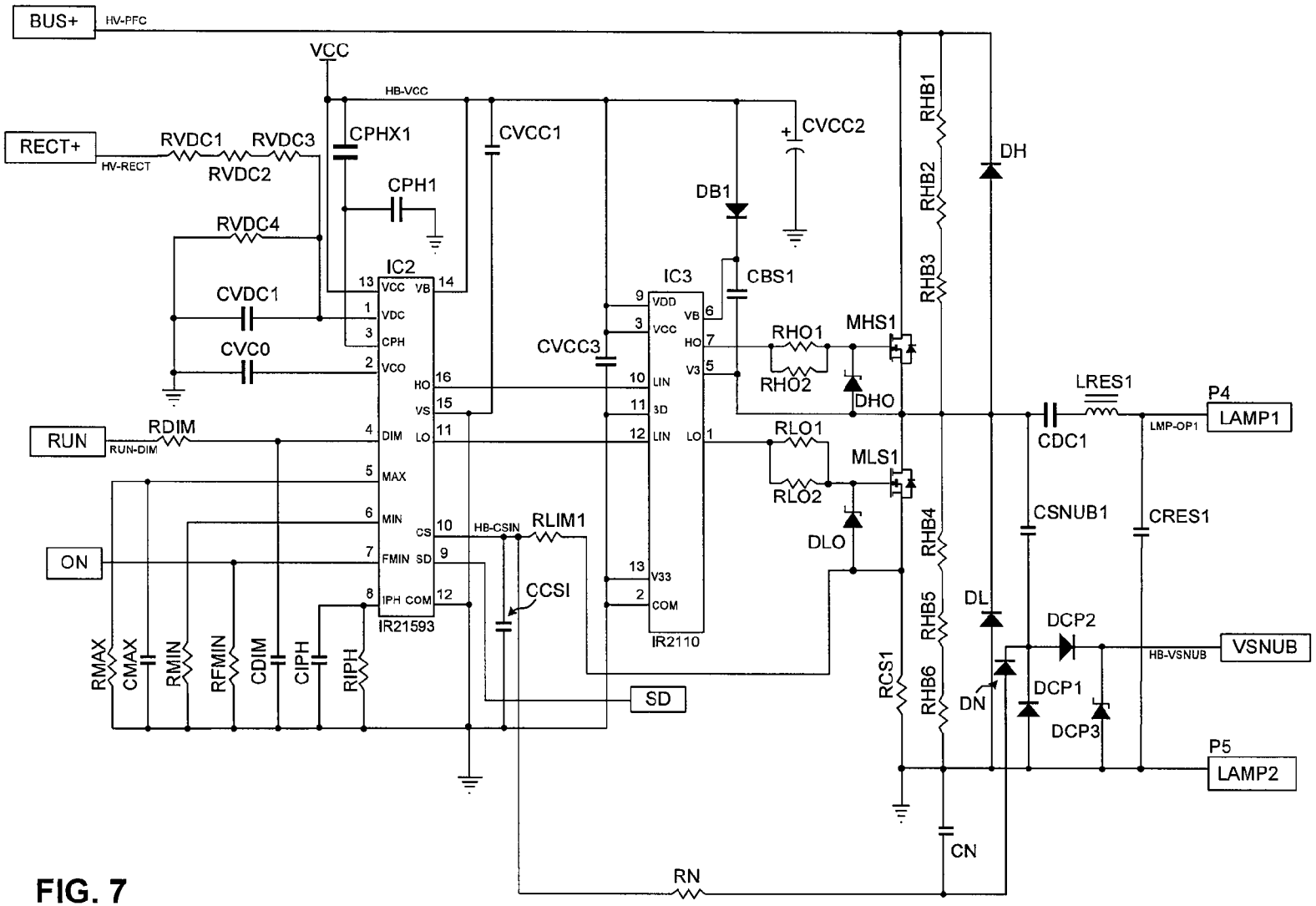
FIG. 7 is a circuit schematic of one embodiment of a ballast controller and output stage in accordance with aspects of the present invention.

The output does not need to be isolated from the input, so a simple zener diode feedback circuit using D11 can be used to provide a well regulated VCC supply voltage between 14V and 15V. This voltage level guarantees that the VCC voltage will exceed the under voltage lockout levels of IC2 and IC3 as shown in FIG. 7. Typical undervoltage lockout levels are UVLO+=12.4V and UVLO−=10.9V. The isolated voltage does not need to be regulated because it will closely track the output voltage, and in addition the isolation circuit contains an 18V zener clamp, D5 (as shown in FIG. 6), that is selected to be sufficient to limit the voltage.

The onboard flyback power supply circuit embodiment shown in FIG. 5 is able to operate efficiently over a wide AC input voltage range. This implementation has significant potential advantages in efficiency over the following two commonly used alternatives: 1) utilizing the auxiliary winding of the power factor correction inductor to obtain a voltage supply—this approach is typically inefficient because the voltage obtained varies with tine and load resulting in high losses under some conditions; 2) obtaining current through a charge pump circuit by means of CSNUB1, DCP1 and DCP—this approach is typically unable to produce sufficient current to power the low voltage circuitry during the warm up phase when a HID lamp is used because the lamp impedance is very low during this time, which prevents sufficient amounts of circulating reactive current from being available.

A further supply may also be provided with the circuit as shown in FIG. 5 for VDD (5V) to power elements of other modules such as microcontroller module 232 as shown in FIG. 2. In an exemplary embodiment as shown in FIG. 5, regulated power to supply a microcontroller, a Microchip PIC12F510 (IC4) within microcontroller module 232, is generated through RVDD1, with zener diode DVDD1 and CVDD1 regulating the supply voltage. Operation of IC4 is further described below.

Embodiments of an Isolated Power Control Interface

In an exemplary embodiment the integrated Flyback regulator may also be configured to provide a galvanically isolated power supply to other modules; for example, modules within isolation subsystem 220. Isolated power may be provided by means of an additional winding for a power control interface, that is controlled by means of an external 0 to 10 VDC control voltage 222 as shown in FIG. 2, which is typically isolated from the main ballast circuitry to comply with safety requirements.

Attention is now directed to FIG. 6 which illustrates isolation circuitry such as may be included in isolation subsystem 220. In a typical embodiment, the power control interface circuit consists of an oscillator which generates a ramp waveform at a low frequency. The oscillator may be based on a programmable unijunction transistor Q1, the gate of which is biased at 9V by the resistor divider comprising R2 and R6. Capacitor C3 is charged through R3 from the 18V auxiliary supply voltage until it reaches a voltage high enough for Q1 to fire. Once the firing voltage is reached, C3 will discharge through Q1 until the current drops below the valley current threshold and Q1 turns off again. In this manner, the voltage on C3 ramps slowly from zero to 10 V and then rapidly discharges back to zero, then repeats this cycle continuously. The ramp waveform is compared with a zero to 10V DC control voltage fed to the ballast by comparator ICCOMP1, which may comprise one stage of a dual comparator IC. If no input is connected, the control voltage is internally pulled up to 10 V through R4 ensuring that the ballast will operate at maximum power by default. The output of ICCOMP1 may be provided to drive the input of an optical isolator circuit (opto-isolator U1), such that U1 is switched on for a shorter duty cycle as the input control voltage increases, and remains continuously off at a 10V maximum input.

The transistor side of opto-isolator U1 may be configurable to allow different implementations for U1. The transistor may be connected to the non-isolated ballast control circuitry and may switch the VCC voltage through a network of resistors and capacitors consisting of R8, R9, RD1, R10, C5 and CBQ1, which may then provide a proportional DC voltage at resistor R10.

Embodiments of Ballast Control Circuitry

Attention is now directed to FIG. 7 which illustrates an embodiment of a ballast control circuit such as might be included in ballast controller 260 as shown in FIG. 2. In an exemplary embodiment, the ballast control circuitry is implemented around an IR21593 (IC2) Dimming Ballast Controller IC available from International Rectifier. Microcontroller IC4 (as shown in FIG. 5) is connected to IC2 so that it is able to detect by means of the FMIN voltage whether the ballast controller is in an active oscillating state or whether it is in a shut down state. The ballast controller is configured to shut down if ignition of the lamp has been unsuccessful.

Figure 10:
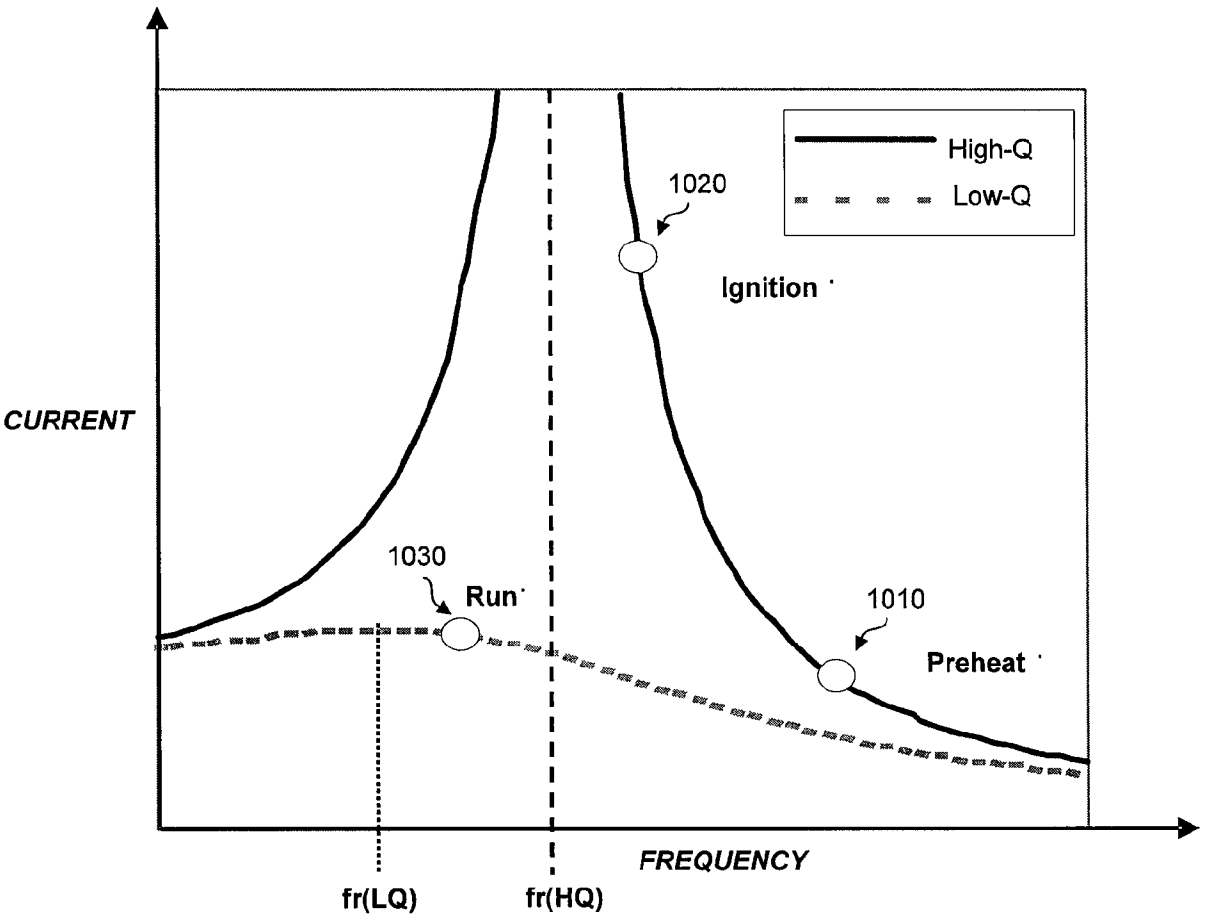
FIG. 10 illustrates lamp current as a function of frequency for an embodiment of the present invention.

In a typically ignition cycle, the frequency of the current supplied to the lamp is set above the resonant frequency of the resonant output network 246. This is illustrated in FIG. 10, where the initial frequency is set at a pre-heat value above resonance. The frequency is then transitioned downward towards toward resonance. As the frequency transitions downward the current in the half-bridge switches MHS1 and MLS1 increases, and a signal proportional to the increasing current is fed back to the CS pin of IC2 through RCS1, RLIM1 and CCS1 to monitor the ignition conditions. If ignition does not occur at a specified ignition frequency (as shown in FIG. 10), the current will continue to increase along with the corresponding signal provided to the CS pin of IC2. Once the signal reaches a predetermined threshold, indicating a failed ignition, IC2 may then be shutdown.

Figure 8:
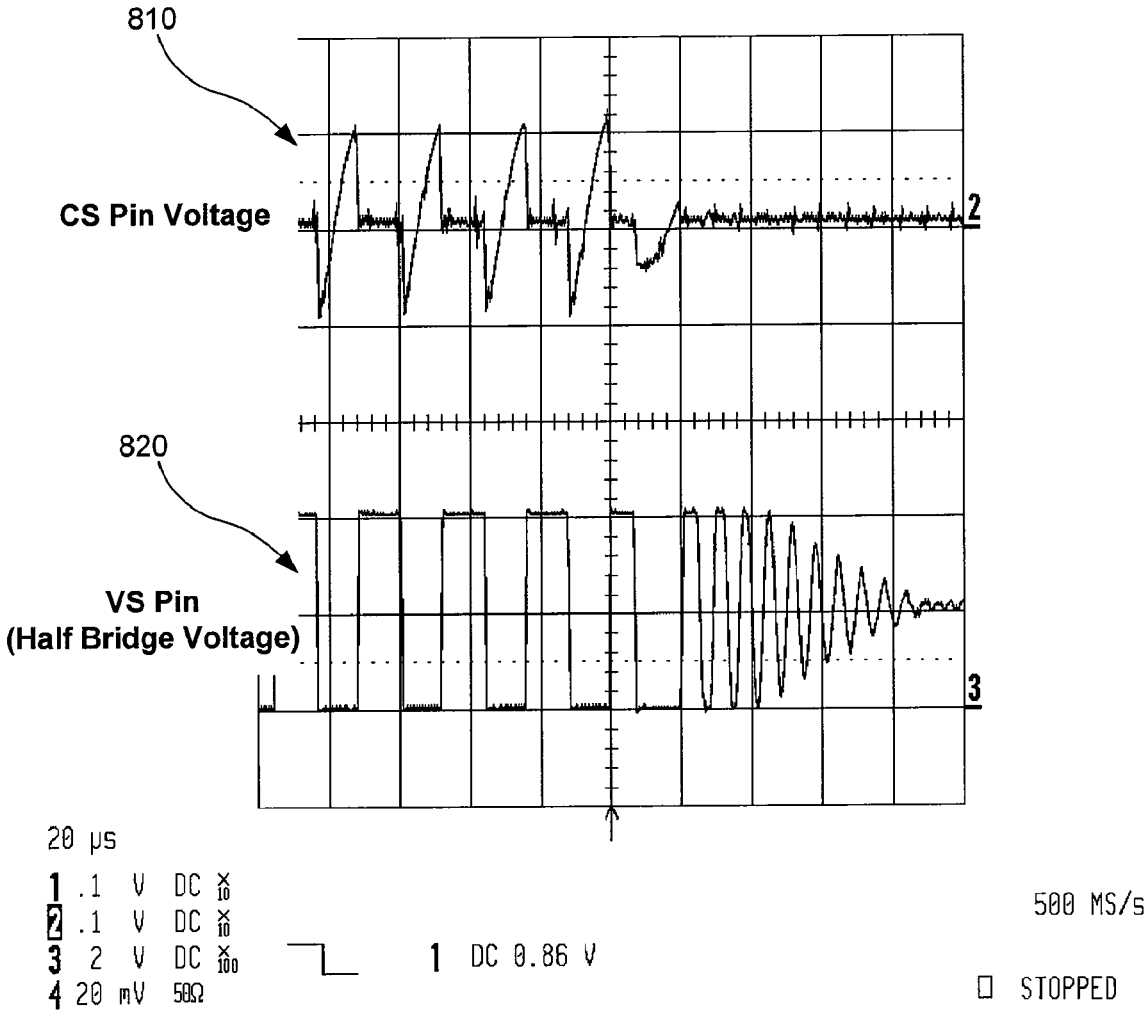
FIG. 8 illustrates signaling displayed as an oscilloscope trace in accordance with an embodiment of the present invention.

FIG. 8 provides additional details of this process in accordance with an embodiment of the invention. Trace 810 is an oscilloscope trace of the CS pin voltage reaching a threshold and the IC (IC2) shutting down. Trace 820 is an oscilloscope trace of the associated VS pin/half-bridge voltage. If the voltage reaches a certain point, such as, for example a fixed threshold of 1.6V, and the lamp has not ignited, the CS pin voltage will a predetermined threshold that triggers IC2 to go into a latched shut down. At this time the FMIN pin of IC2 transitions from 5V to 0V and microcontroller IC4 detects this through pin 7. In order to do this, IC4 may be configured such that pin 7 operates as one input of a comparator, with the input compared to a reference voltage, such as a reference voltage of 2.5V, provided at pin 6.

Figure 3:
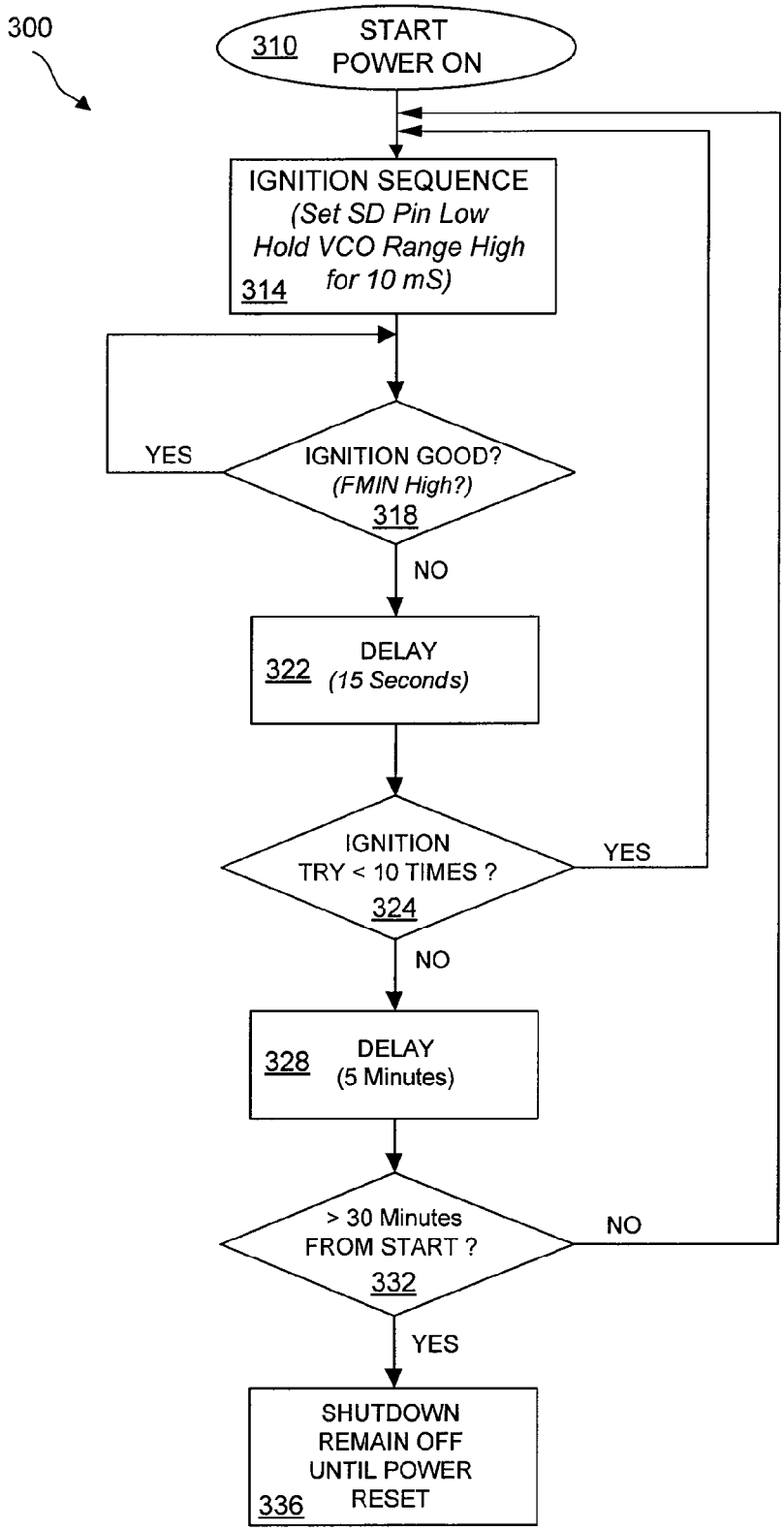
FIG. 3 is a state diagram illustrating one embodiment of a ballast operating sequence in accordance with aspects of the present invention.

In an exemplary embodiment IC4 is a PIC12F510 microcontroller available from Microchip, Inc. IC4 may include functionality implemented in the form of one or more software modules that may be programmed into on-chip memory provided for storage and execution of program instructions. Alternately, other microcontrollers may be used, as well as other programmable logic devices such as programmable gate arrays (PGAs) and the like. One implementation of such a software module configured to enable functionality of microcontroller IC4 is described in the flow chart shown in FIG. 3. It will be noted that the process as shown in FIG. 3 is provided for purposes of illustration, not limitation, and therefore other equivalent processes including the same or different steps may alternately be used. In addition, other software modules providing additional functionality in addition to that shown in FIG. 3 may be provided.

As shown in FIG. 3, microcontroller IC4 may first provide signaling to start the lamp ignition process at step 310. This process may include one or more steps providing a lamp ignition sequence 314.

After lamp ignition is attempted, lamp ignition is tested at step 318. If ignition is good, process execution may continue by returning to step 318 to periodically check ignition status. In some embodiments execution may alternately and/or additionally continue to a normal running mode (not shown in FIG. 3).

Alternately, if ignition fails at step 318 by, for example, detection of shutdown of IC2 through the FMIN pin of IC4 as described previously, microcontroller IC4 will wait for a predetermined period at step 322, which in an exemplary embodiment may be 15 seconds, and then may initiate a restart of the lamp ignition process by driving the shutdown (SD) input of ballast controller IC2 first high and then low again. The process will initiate a restart of the ballast controller IC2, causing it to go through the ignition sequence again at step 324. This process may then be repeated for a pre-determined number of times, in an exemplary embodiment 10 times, and if the lamp fails to ignite during this period the microcontroller will delay for a longer period of time at step 328, in an exemplary embodiment 5 minutes. At the end of this longer period the entire sequence will be repeated again with program execution returning from step 332 to step 314. If the time from starting step 310 to step 332 is greater than a predetermined threshold, in an exemplary embodiment 30 minutes, ballast ignition will be shut down indefinitely or until the AC power is switched off or until another condition associated with an invalid ignition is satisfied.

The microcontroller may also be configured to provide an additional frequency adjustment to the ballast controller. This may typically be done by adjusting the starting frequency to a higher value by means of sinking additional current from the FMIN input for a period of 10 mS when the ballast is first started up, thereby preventing spontaneous ignition of the lamp when power is first switched on and ensuring that the correct ignition sequence is performed. In an exemplary embodiment, this process is begun by configuring the microcontroller to initiate the lamp start sequence by driving the SD input of IC2 high and then low. The frequency range of the VCO within IC2 is shifted upwards by connection of an additional resistor R14 to COM through the microcontroller IC4 and diode D14. The PIC microcontroller IC4 has a CMOS output (pin 4) that can be switched to COM internally, effecting this function. After 10 milliseconds resistor R14 may then be disconnected allowing the frequency range to shift back down to normal. A capacitor C13 may also added to create a gradual transition of the frequency. This functionality may be used to prevent the lamp from igniting immediately when the ballast is switched on and also allows the ballast to start at a frequency sufficiently above resonance to make premature ignition impossible, thereby allowing the frequency to transition smoothly down to resonance to provide an ignition sequence that does not put undue stress on the half-bridge switches (MHS1 and MLS1 as illustrated in FIG. 7) and driver IC.

When a lamp is ignited during a normal ignition sequence, the lamp may initially undergo a warm-up period as controlled by IC2. When the lamp then reaches a desired operating power after the warm-up period, the lamp power may be regulated by means of the phase control loop regulator incorporated within IC2. This regulation process operates by detecting the zero crossing current in the resonant output circuit by means of current sense resistor RCS1. The phase difference between this zero crossing and the half-bridge switching voltage varies according to the lamp power in a linear fashion. When the frequency is adjusted the lamp power changes and therefore the phase difference also changes. IC2 incorporates a phase locked loop that modulates the frequency to maintain a constant phase difference and lamp power.

This phase control system implementation allows the HID ballast to operate with a variety of different types of metal halide and high pressure sodium lamps of the same rated power, and will provide the correct driving power in each case even though the impedance characteristics may differ considerably between these different lamp types. In a typical embodiment, this represents an advantage over a design that operates at a fixed frequency, which would be typically be limited to only supplying the correct power to lamps of similar impedance.

Figure 9B:
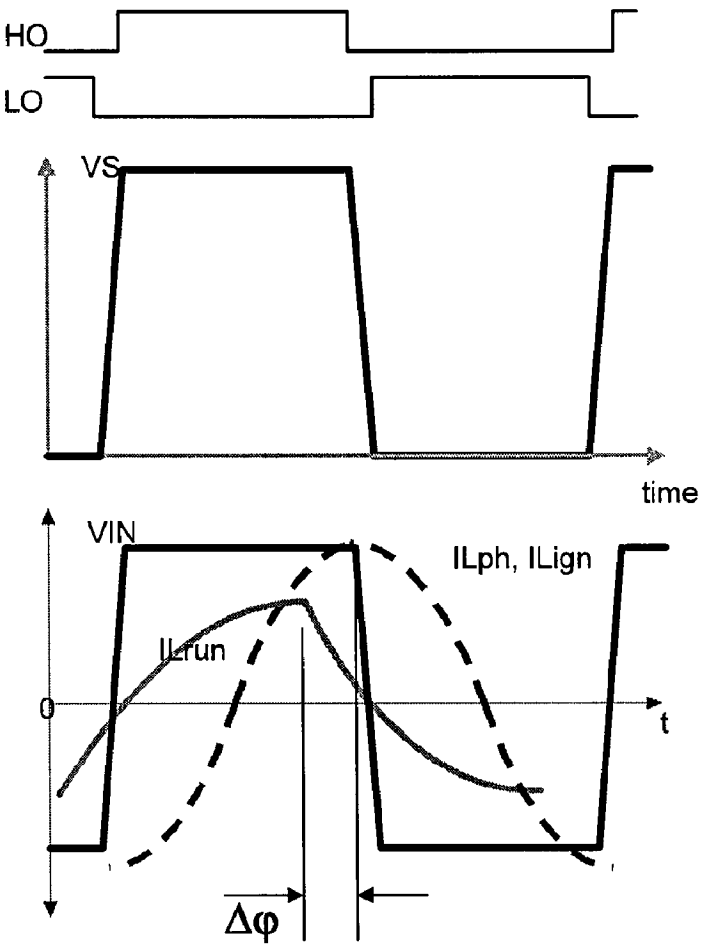
FIG. 9*b* illustrates voltage and current waveforms associated with the circuit shown in FIG. 9*a*.
Figure 9A:
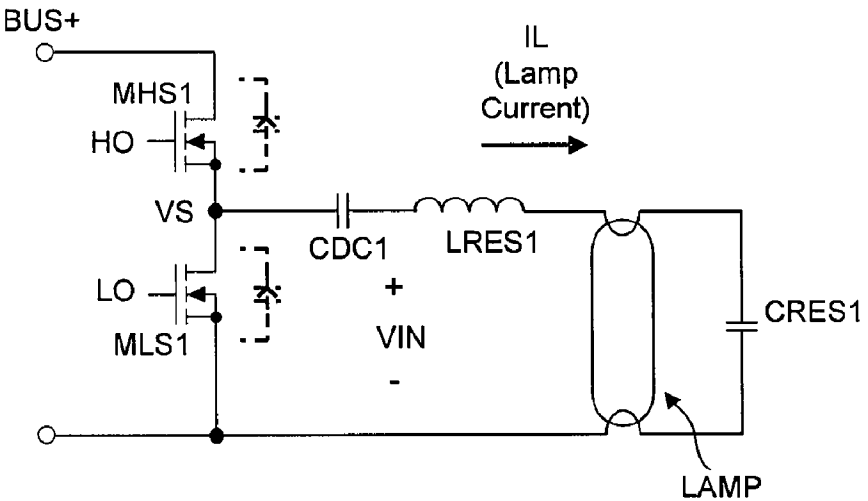
FIG. 9*a* illustrates a simplified embodiment of a lamp output and resonant circuit in accordance with aspects of the present invention.

Additional aspects of a lamp ignition process in accordance with an embodiment of the invention are described as follows with respect to FIG. 9 and FIG. 10. FIG. 9*a* illustrates a simplified output stage section of the circuit shown in FIG. 7. Half-bridge MOSFET switches MHS1 and MLS1 are controlled by signals HO and LO from IC3 (as shown in FIG. 7). FIG. 9*b* illustrates switching signals HO and LO as a function of time during a lamp ignition cycle, and VS illustrates the corresponding voltage at the center of the half-bridge. VS is highpass filtered by CDC1 to remove the DC component, resulting in VIN, the input to a resonant network comprising LRES1 and CRES1. VIN will nominally have a peak amplitude of half of BUS+ as shown in FIG. 9*b*. During operation current IL flows to the lamp through LRES1.

During lamp operation the output circuit may be modeled as a High-Q circuit prior to ignition and a Low-Q circuit after ignition, due to changes in the impedance characteristics of the circuit post-ignition. In a typical ignition cycle, operation initially follows the High-Q curve as shown in FIG. 10. The frequency of IL is typically initially set above the resonant frequency of resonant output network 246 at a preheat frequency 1010. The frequency will then be gradually reduced, and IL will increase, until sufficient current is provided to trigger ignition at frequency 1020. Following ignition, operation will then follow the Low-Q curve. The frequency will be reduced to a frequency 1030 below resonance, and power output may then be adjusted by varying the frequency, resulting in changes in the associated phase ($\Delta\phi$ as shown in FIG. 9*b*). During the preheat and ignition phase, current through the lamp will be approximately sinusoidal as shown in FIG. 9*b* (ILph during the preheat phase, ILign during the ignition phase), whereas during the running phase, ILrun will be approximately exponentially increasing and decreasing, thereby generating harmonics that may be filted by EMI Filter 252 and/or associated circuitry.

In a typical embodiment the half-bridge MOSFET switches MHS1 and MLS1 are relatively large and require a substantial gate drive current. This current may be provided by means of an additional high current high and low side driver IC3. IC3 may comprise an IR2110 High and Low Side Driver IC, available from International Rectifier. IC3 may be driven by high impedance inputs supplied by IC2, where the floating high side driver is connected to 0V and where the LO and HO outputs need only supply minimal output drive. This configuration removes the need for ballast controller IC2 from supplying significant output drive, which prevents it from running at increased temperature, consequently improving reliability.

Embodiments of the phase control system described herein also allows the lamp power to be adjusted to lower levels by means of a DC control voltage supplied to the DIM pin of IC2. In an exemplary embodiment the DC control voltage may be derived from the isolated control interface as described previously to isolate the control voltage input from the ballast. In the exemplary embodiment shown in FIGS. 4-7, the ballast has been designed to reduce the lamp power to a certain minimum level and not to attempt to dim the lamp to lower levels. The motivation behind this implementation is to save energy as opposed to provide dimming operation. It is noted that HID lamps generally may not be dimmed below 40% of their rated maximum power because at lower power levels the discharge arc becomes unstable and the color changes. These effects differ substantially between different lamp types. It is also noted that arc instability is undesirable in HID lamps as it can cause damage to the lamp and reduced life. In some cases this may also lead to acoustic resonance occurring that can cause the lamp to explode, however this is generally only found to occur in much lower power metal halide lamps than 400W. Nevertheless, variations on the design that implement additional dimming based on lamps supporting such functionality are fully contemplated herein within the spirit and scope of the invention.

Half-Bridge and Output Stage

Attention is now directed to FIG. 7 which illustrates an embodiment of a half-bridge module 244 and resonant output network 246 as shown in FIG. 2.

The driver IC3 drives MOSFETs MHS1 and MLS1. The inverter stage consists of two totem pole or half-bridge configured N-channel power MOSFETs with their common node supplying the lamp network. As shown in FIG. 7, MOSFETS MHS1 and MLS1 may be driven out of phase by the low side and high side driver IC3 with close to a fifty percent duty cycle. A small dead time may be included to prevent the possibility of shoot through, which can happen due to delays in switching the MOSFETs off.

A snubber circuit may be included to reduce the dv/dT at the half-bridge and thus reduce the high frequency noise that may be transmitted back to the AC line. It may also supply current through capacitor CSNUB1, which can be converted to a DC voltage by means of diodes DCP1 and DCP2 if a capacitor is placed from VSNUB to LAMP2. This DC voltage may be clamped by Zener diode DCP3. This voltage may also be used to supply additional VCC current to IC1, IC2 and IC3 if required.

In summary, in a typical embodiment a ballast, including a microprocessor or equivalent device controlling ballast operation, converts standard 50 or 60 Hz line voltage into a square-wave output, typically at a frequency of 50-200 KHz. The high frequency power output is used to drive a lamp through a resonant network consisting of a series inductor and parallel capacitor. A series inductor limits the current to the lamp, and a parallel capacitor is used to create a resonant circuit, which produces the high voltages required to ignite the lamp at startup.

In exemplary embodiments, the ballast described here is capable of driving a variety of different lamp types and has demonstrated the capability of operating at better than 90% efficiency at maximum power. The ballast may also provide a high power factor and be operable over a wide range of AC input voltages. In addition, typical embodiments may be configured to operate in a power saving mode, where output power can be reduced significantly below maximum power, for example in one embodiment to 40% of maximum power. Ballasts and associated lighting systems in accordance with the present invention also provide additional features and functions as described and illustrated herein.

As noted previously, some embodiments of the present invention may include computer software and/or computer hardware/software combinations configured to implement one or more processes or functions associated with the present invention. These embodiments may be in the form of modules implementing functionality in software and/or hardware software combinations. Embodiments may also take the form of a computer storage product with a computer-readable medium having computer code thereon for performing various computer-implemented operations, such as operations related to functionality as describe herein. The media and computer code may be those specially designed and constructed for the purposes of the present invention, or they may be of the kind well known and available to those having skill in the computer software arts, or they may be a combination of both.

Examples of computer-readable media within the spirit and scope of the present invention include, but are not limited to: magnetic media such as hard disks; optical media such as CD-ROMs, DVDs and holographic devices; magneto-optical media; and hardware devices that are specially configured to store and execute program code, such as programmable microcontrollers, application-specific integrated circuits ("ASICs"), programmable logic devices ("PLDs") and ROM and RAM devices. Examples of computer code may include machine code, such as produced by a compiler, and files containing higher-level code that are executed by a computer using an interpreter. Computer code may be comprised of one or more modules executing a particular process or processes to provide useful results, and the modules may communicate with one another via means known in the art. For example, some embodiments of the invention may be implemented using assembly language, Java, C, C#, C++, or other programming languages and software development tools as are known in the art. Other embodiments of the invention may be implemented in hardwired circuitry in place of, or in combination with, machine-executable software instructions.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following Claims and their equivalents define the scope of the invention.

I claim:

1. A ballast comprising:

a lamp control subsystem disposed to provide a lamp control signal, the lamp control subsystem including (i) a ballast control circuit for providing said lamp control signal: (ii) a processor operatively coupled to said ballast control circuit; and (iii) a memory, operatively coupled to said processor, said memory configured to store processor readable logical instructions wherein execution of the logical instructions by the processor results in the performing of at least the following operations: controlling a predefined lamp ignition sequence; determining whether a lamp operatively connected to said ballast has ignited; and based on said operations, controlling in part operation of said lamp;

a lamp drive subsystem disposed to receive said lamp control signal and provide a lamp drive signal; and an output network disposed to receive said lamp drive signal and provide a lamp drive output signal.

2. The ballast of claim 1 wherein said execution of the logical instructions by the processor further results in the performing of the following operation:

based on said determining, turning off operation of said ballast.

3. The ballast of claim 1 wherein said lamp control subsystem comprises a phase control circuit disposed to maintain said lamp drive output signal at a user-selectable output power level.

4. The ballast of claim 3 wherein said phase control circuit is disposed to measure the phase between the voltage and current of said lamp drive output signal and adjust the frequency of said lamp drive output signal to maintain said user-selectable output power level; wherein said user selectable output power level is related to said phase between said voltage and current.

5. The ballast of claim 3 wherein said user-selectable output power level is set by a lamp power level signal provided to said lamp control subsystem.

6. The ballast of claim 5 further comprising an isolation circuit disposed to receive a lamp power level input signal and provide said lamp power level signal, said isolation circuit disposed to electrically isolate said lamp power level signal and said lamp power level input.

7. The ballast of claim 6 wherein said isolation circuit comprises an opto-isolation circuit.

8. The ballast of claim 6 wherein said lamp power level input signal comprises a square wave signal with a variable duty cycle, said duty cycle proportional to a user desired lamp power level.

9. The ballast of claim 1 further comprising a power supply subsystem, said power supply subsystem disposed to supply power to said lamp control subsystem and said lamp drive subsystem.

10. The ballast of claim 9 wherein said power supply subsystem comprises a flyback power supply disposed to provide one or more low level voltages to said lamp control subsystem and said lamp drive subsystem.

11. The ballast of claim 1 further comprising:

a power supply circuit disposed to receive power from an external power source and provide one or more voltage regulated power sources to said lamp control subsystem and lamp drive subsystem; and a power factor correction module disposed to provide substantially constant input power factor to said external power source.

12. The ballast of claim 1 wherein said lamp drive subsystem comprises a pair of MOSFET transistors disposed to generate said lamp drive signal.

13. The ballast of claim 1 wherein said output network comprises a resonant tuned circuit.

14. The ballast of claim 13 wherein said resonant tuned circuit comprises an L-C circuit.

15. The ballast of claim 1 wherein said execution of the logical instructions by the processor further results in the performance of the following operation:

adjusting the frequency of an output signal provided by a voltage controlled oscillator within said lamp control subsystem to vary said lamp control signal so as to prevent premature lamp ignition at startup of a lamp operatively connected to said ballast.

16. The ballast of claim 1 wherein said execution of the logical instructions by the processor further results in the performance of the following operation:

determining whether a lamp connected to said ballast is in an active oscillating state; and based on said determining, latching said ballast in an off state.

17. The electronic ballast of claim 1 wherein said circuit for providing said lamp control signal comprises a ballast control IC; said ballast control IC operatively coupled to said processor.

18. The ballast of claim 17 further comprising a delay circuit operatively connected to said processor and said ballast control IC, said delay circuit configured to provide a gradual transition of the frequency of said lamp control signal after ignition of a lamp connected said ballast.

19. The ballast of claim 17 wherein said execution of logical instructions by the processor further results in the performance following operation:

determining, during a lamp ignition cycle, whether said ballast control IC is in an oscillating state; and based on said determining, restarting said ballast control IC if said ballast control IC is not in an oscillating state.

20. The ballast of claim 19 wherein said operations of determining said restarting are repeated up to a predefined number of times.

21. A lighting system comprising:

a HID lamp; and the ballast of claim 1.

22. A method comprising the steps of:

providing a lamp control signal with a lamp control subsystem, the lamp control subsystem including (i) a ballast control circuit for providing said lamp control signal; (ii) a processor operatively coupled to said ballast control circuit; and (iii) a memory, operatively coupled to said processor, said memory configured to store processor readable logical instructions wherein execution of the logical instructions by the processor results in the performing of at least the following operations: controlling a predefined lamp ignition sequence; determining whether a lamp operatively connected to said ballast has ignited; and based on said operations, controlling in part operation of said lamp;

receiving the lamp control signal with a lamp drive subsystem that provides a lamp drive signal; and receiving the lamp drive signal with an output network that provides a lamp drive output signal.

23. A ballast comprising:

a lamp control subsystem disposed to provide a lamp control signal, the lamp control subsystem comprising (i) a ballast control circuit for providing said lamp control signal; (ii) a processor operatively coupled to said ballast control circuit; and (iii) a memory, operatively coupled to said processor, said memory configured to store processor readable logical instructions; wherein execution of the logical instructions by the processor results in the performing of one of the following operations: controlling a predefined lamp ignition sequence; determining whether a lamp operatively connected to said ballast has ignited; and based on at least one of the operations, controlling in part operation of said lamp;

a lamp drive subsystem disposed to receive said lamp control signal and provide a lamp drive signal; and an output network disposed to receive said lamp drive signal and provide a lamp drive output signal.

24. The ballast of claim 23 wherein execution of the logical instructions by the processor results in controlling operation of a lamp.

25. A lighting system comprising a HID lamp and the ballast of claim 23.

26. A method comprising the steps of:

providing a lamp control signal with a lamp control subsystem, the lamp control subsystem comprising (i) a ballast control circuit for providing said lamp control signal; (ii) a processor operatively coupled to said ballast control circuit; and (iii) a memory, operatively coupled to said processor, said memory configured to store processor readable logical instructions; wherein execution of the logical instructions by the processor results in the performing of one of the following operations: controlling a predefined lamp ignition sequence; determining whether a lamp operatively connected to said ballast has ignited; and based on at least one of the operations, controlling in part operation of said lamp;

receiving the lamp control signal with a lamp drive subsystem that provides a lamp drive signal; and receiving the lamp drive signal with an output network that provides a lamp drive output signal.

27. The method of claim 26 further comprising the step of controlling operation of a lamp via execution of the logical instructions by the processor.

28. A method for making a lighting system comprising the steps of providing a HID lamp and controlling operation of the HID lamp with the method of claim 26.

* * * * *